US007882036B1

(12) United States Patent
Yankloski et al.

(10) Patent No.: US 7,882,036 B1
(45) Date of Patent: Feb. 1, 2011

(54) SYSTEM AND METHOD FOR POSTAL INDICIA PRINTING EVIDENCING AND ACCOUNTING

(75) Inventors: Richard A. Yankloski, Webster, NY (US); Kenneth M. Yankloski, Webster, NY (US); John A. Keirsbilck, Rochester, NY (US)

(73) Assignee: Data-Pac Mailing Systems Corp., Webster, NY (US)

( * ) Notice: Subject to any disclaimer, the term of this patent is extended or adjusted under 35 U.S.C. 154(b) by 0 days.

(21) Appl. No.: 11/799,359

(22) Filed: May 1, 2007

Related U.S. Application Data

(60) Provisional application No. 60/796,452, filed on May 1, 2006.

(51) Int. Cl.
*G07B 17/00* (2006.01)

(52) U.S. Cl. ..... 705/62; 705/401; 705/404; 705/408

(58) Field of Classification Search ..... None
See application file for complete search history.

(56) References Cited

U.S. PATENT DOCUMENTS

| | | | |
|---|---|---|---|
| 4,725,718 | A | 2/1988 | Sansone et al. |
| 4,757,537 | A | 7/1988 | Edelmann et al. |
| 4,775,246 | A | 10/1988 | Edelmann et al. |
| 4,809,185 | A | 2/1989 | Talmadge |
| 4,831,555 | A | 5/1989 | Sansone et al. |
| 4,858,138 | A | 8/1989 | Talmadge |
| 4,873,645 | A | 10/1989 | Hunter et al. |
| 4,918,601 | A | 4/1990 | Vermesse |
| 5,050,078 | A | 9/1991 | Sansone |
| 5,146,544 | A | 9/1992 | Altham et al. |
| 5,185,798 | A | 2/1993 | Hamada et al. |
| 5,340,097 | A | 8/1994 | Yankloski |
| 5,353,350 | A | 10/1994 | Unsworth et al. |
| 5,396,558 | A | 3/1995 | Ishiguro et al. |
| 5,410,590 | A | 4/1995 | Blood et al. |
| 5,479,509 | A | 12/1995 | Ugon |
| 5,538,234 | A | 7/1996 | Yankloski |

(Continued)

OTHER PUBLICATIONS

RENA Systems Home Page—http://www.addressingmail.com/home.htm, 2004.

(Continued)

*Primary Examiner*—Calvin L Hewitt, II
*Assistant Examiner*—Mohammad A Nilforoush
(74) *Attorney, Agent, or Firm*—Kenneth J. Lukacher

(57) ABSTRACT

System and method for printing indicia on mailing items, such as envelopes, cards, or label media, has a host computer system connected to a postal security device. The postal security device stores postage funds and, responsive to the host computer postage requests, provides data to the host computer representing an IBI Lite barcode having at least part of a unique authentication code. The host computer utilizes such data to produce print data representing postage indicia, and send such print data to one of a mailing machine, stand-alone printer, or printing system, for printing on a mailing item to be associated with the authentication code. A plurality of host computer systems each with their respective PSD may be provided. A reset computer system can communicate with each PSD, via their respective host computer, to provide additional postage funds and to receive information representing transaction data stored in the host computer.

37 Claims, 12 Drawing Sheets

U.S. PATENT DOCUMENTS

| | | | | | |
|---|---|---|---|---|---|
| 5,666,284 | A | | 9/1997 | Kara | |
| 5,682,427 | A | | 10/1997 | Seestrom | |
| 5,767,452 | A | | 6/1998 | Yankloski | |
| 5,793,867 | A | | 8/1998 | Cordery et al. | |
| 5,796,834 | A | | 8/1998 | Whitney et al. | |
| 5,822,738 | A | * | 10/1998 | Shah et al. | 705/410 |
| 5,841,658 | A | | 11/1998 | Bouchard | |
| 5,917,925 | A | * | 6/1999 | Moore | 382/101 |
| 6,009,416 | A | | 12/1999 | Pintsov | |
| 6,073,125 | A | | 6/2000 | Cordery et al. | |
| 6,085,181 | A | | 7/2000 | Gravell et al. | |
| 6,125,357 | A | * | 9/2000 | Pintsov | 705/408 |
| 6,151,591 | A | * | 11/2000 | Pierce et al. | 705/401 |
| 6,175,826 | B1 | | 1/2001 | Malandra, Jr. et al. | |
| 6,202,057 | B1 | * | 3/2001 | Pierce | 705/408 |
| 6,240,403 | B1 | | 5/2001 | Shah et al. | |
| 6,308,165 | B1 | | 10/2001 | Gilham | |
| 6,381,589 | B1 | | 4/2002 | Leon | |
| 6,424,954 | B1 | | 7/2002 | Leon | |
| 6,609,117 | B2 | | 8/2003 | Sutherland et al. | |
| 7,113,928 | B1 | * | 9/2006 | L'Hote et al. | 705/60 |
| 7,152,049 | B2 | | 12/2006 | Ryan, Jr. | |
| 7,191,158 | B2 | | 3/2007 | Ogg et al. | |
| 7,194,957 | B1 | | 3/2007 | Leon et al. | |
| 7,203,666 | B1 | | 4/2007 | Gravell et al. | |
| 7,233,930 | B1 | | 6/2007 | Ryan, Jr. et al. | |
| 7,343,357 | B1 | | 3/2008 | Kara | |
| 2002/0143714 | A1 | | 10/2002 | Allport et al. | |
| 2003/0102374 | A1 | | 6/2003 | Wojdyla et al. | |
| 2004/0054547 | A1 | | 3/2004 | Rozendaal et al. | |
| 2004/0059676 | A1 | | 3/2004 | Rozendaal et al. | |
| 2004/0064423 | A1 | | 4/2004 | Rozendaal et al. | |
| 2004/0073522 | A1 | | 4/2004 | Rozendaal et al. | |
| 2006/0108266 | A1 | | 5/2006 | Bowers et al. | |
| 2006/0173800 | A1 | | 8/2006 | Mattern | |
| 2007/0150423 | A1 | | 6/2007 | Kirschner et al. | |
| 2007/0288760 | A1 | | 12/2007 | Euchner et al. | |

OTHER PUBLICATIONS

United States Postal Service, Intelligent Mail Barcode—Web Page at http://ribbs.usps.gov/OneCodeSOLUTION/, Apr. 25, 2007.

RENA Systems Product Information—http://www.addressingmail.com/products_software_flexmail.htm, 2004.

U.S. Department of Commerce, FIPS PUB 198, Federal Information Processing Standards Publication, The Keyed-Hash Message Authentication Code (HMAC), Issued Mar. 6, 2002.

U.S. Department of Commerce, FIPS PUB 46-3, Federal Information Processing Standards Publication, Reaffirmed Oct. 25, 1999.

Postal Service, Introducing OneCode Confirm, Rev8.2, Mar. 15, 2006.

Maxim Integrated Products, Inc., iButton eCash Token with World-Class Digital Security and Stainless-Steel Durability, 2005.

Dallas Semiconductor Corp., DS1954B Cryptographic iButton FIPS 140-1 Non-Proprietary Cryptographic Module Security Policy, 1998.

Data-Pac Mailing Systems Corporate Brochure, eSMART-MAiL Software, Feb. 2006.

Data-Pac Mailing Systems Corporate Brochure, eSMART-MAiL Manager Software, Feb. 2006.

Data-Pac Mailing Systems Corporate Brochure, USHIPSAVER, Feb. 2006.

* cited by examiner

FIG. 5B
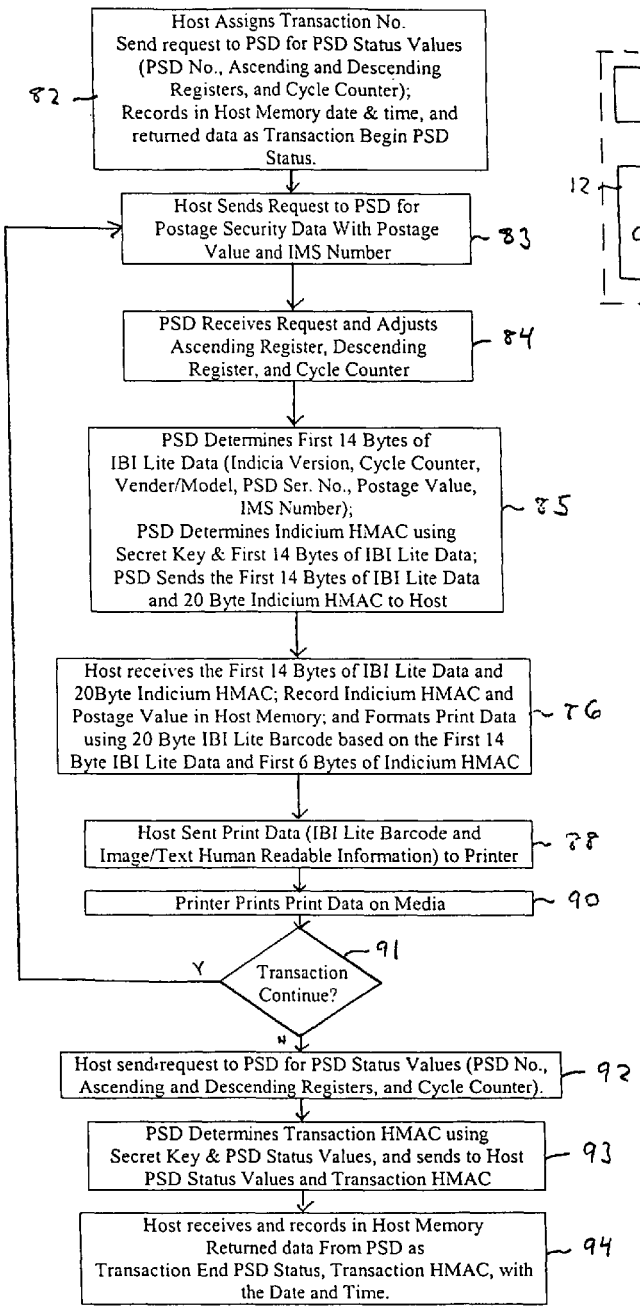
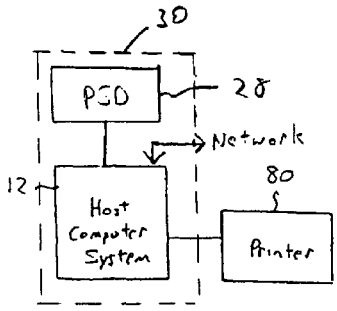
FIG. 5A

SYSTEM AND METHOD FOR POSTAL INDICIA PRINTING EVIDENCING AND ACCOUNTING

This application claims the priority benefit of U.S. Provisional Application No. 60/796,452, filed May 1, 2006, which is herein incorporated by reference.

FIELD OF THE INVENTION

The present invention relates to a system and method for postal indicia printing, evidencing and accounting. The invention provides print indicia on mailing items, such as envelopes, cards, or adhesive-backed label media, having an IBI Lite barcode with embedded evidencing provided by a security code, which is traceable to a transaction on the mailing machine or printer which printed such indicia.

BACKGROUND OF THE INVENTION

The U.S. Post Office allows use of machine readable Information Based Indicia (IBI) barcodes on envelopes or labels attached to envelopes, instead of traditional stamps, in which such barcodes provide information relating to the postal meter that expensed postal funds. Such IBI barcode encodes up to 112 bytes of information, including a digital signature traceable to the postal meter that printed the code, so as to avoid fraudulent use of postage. The IBI barcode however utilizes a large amount of ink, especially when processing large amounts of mail.

To reduce the amount of ink, a much smaller IBI Lite barcode may be used, which encodes 14 bytes, but lacks a digital signature. The benefit of reduced ink usage sacrifices the presence of an encoded digital signature, thereby making traceability for evidencing and accounting of postage used by meters utilizing IBI Lite barcode difficult.

Moreover, because less information is provided using an IBI Lite barcode than full IBI barcodes, the post office requires controlled acceptance by post office personnel of envelopes or items having IBI Lite barcodes, and thus unlike full IBI barcodes, envelopes having IBI Lite barcodes cannot be placed in a traditional USPS letter collection boxes. Controlled acceptance of envelopes having IBI Lite barcode is also required because such envelopes usually lack Facing Identification Mark (FIM) orientation lines, along their edge.

Thus, it is desirable to print postal indicia on envelopes with IBI Lite barcodes with enhanced security, which enables evidencing and accounting of postage in accordance with such IBI Lite barcodes, and thereby provide both the benefit of reduced ink usage plus fraud detection capability.

SUMMARY OF THE INVENTION

Accordingly, it is an object of the present invention to provide a system and method for printing postal indicia on mailing items utilizing IBI Lite barcodes that provides enhanced security features and traceability for evidencing and accounting of postage used.

It is further an object of the present invention to provide a system and method for printing postal indicia utilizing IBI Lite barcodes that further provides USPS letter box acceptability.

Briefly described, the system embodying the present invention has a host computer system and a postal security device connected for data communication with the host computer system. The postal security device stores postage funds and provides to the host computer system data representing an IBI Lite barcode having at least part of a unique authentication code in response to a request from the host computer system, in which the authentication code is associated with a mailing item upon which the IBI Lite barcode will be printed. The host computer system utilizes such data to produce print data representing postage indicia for use on the mailing item having the IBI Lite barcode and image and/or text information. The system may further have one or more of a mailing machine, a stand-alone printer, or printing system, connected to the host computer system for receiving and printing such print data on the mailing item.

One or more successive mailing items processed are associated with a transaction, and for each transaction the host computer system stores transaction data in its memory representing the status of the PSD at the start and end of each transaction, and for each mailing item processed for that transaction its postage value and at least part of the unique authentication code generated by the PSD.

A plurality of host computer systems each with their respective PSD may be provided. A reset computer system separate from each of the mailing machines can communicate with the PSD, via their respective host computer system, to provide additional postage funds and to receive information from the host computer system representing the transaction data stored in the host computer system since the last communication with the reset computer system.

A method is also provided for generating indicia for printing on mailing items having the steps of: sending a request from a host computer system for postage to a postal security device storing postage funds; generating by the postal security device an authentication code in response to the request; sending data from the postal security device to the requesting host computer system representing an IBI Lite barcode having at least part of the authentication code; utilizing the data to produce print data representing postage indicia having the IBI Lite barcode with image/text information; and printing the print data on a mailing item to be associated with the authentication code. The method may further have the steps of: storing transaction data at the host computer system representing at least the postage value and the authentication code for each one of a group of one or more successive mailing items printed upon; sending the transaction data from the host computer system over a network to a reset computer system for storage of the transaction data; and resetting the postage funds stored in the postal security device by the reset computer system.

Although the term envelope is used herein it refers to any mailing item, such as a single sheet, postcard, or label media upon which postage indicia may be printed. Further, although IBI Lite barcodes are described, all or part of the authentication code may be printed in other representations (e.g., OneCode barcode) on mail with or without an IBI Lite barcode.

BRIEF DESCRIPTION OF THE DRAWINGS

The foregoing and other features, objects, and advantages of the invention will become more apparent from a reading of the following detailed description in connection with the accompanying drawings, in which:

FIG. 5A is a block diagram of another embodiment of the present invention using a typical printer, rather than the mailing machine of FIG. 1;

FIG. 5B is a flowchart showing the operation of system of FIG. 5A;

DETAILED DESCRIPTION OF THE INVENTION

Figure 1:
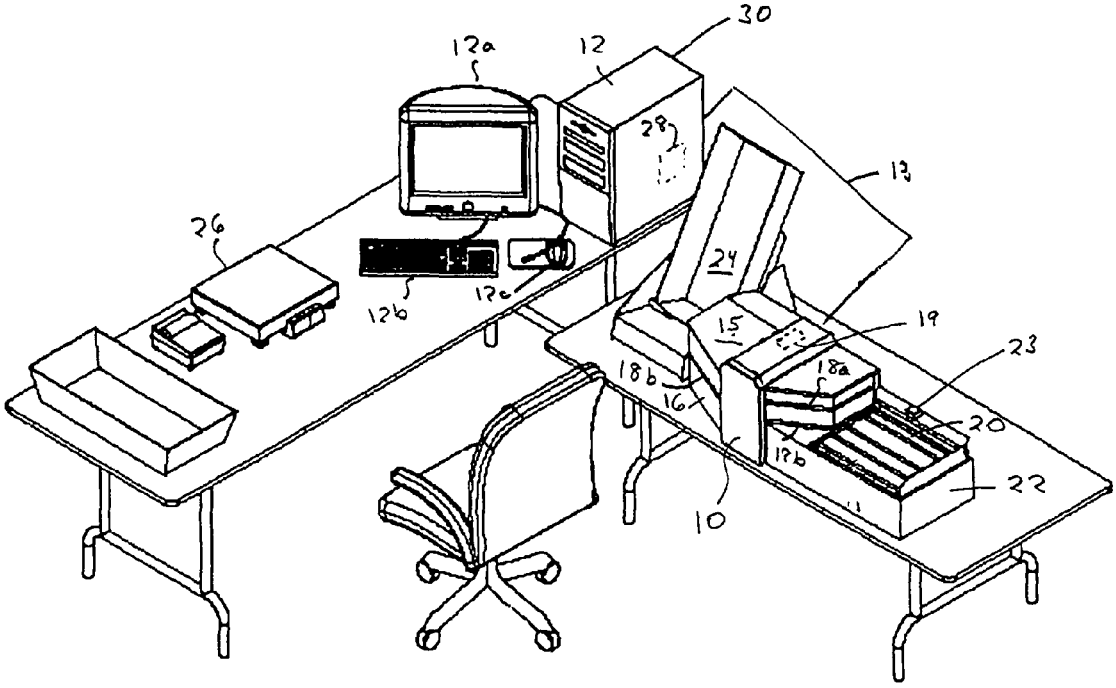
FIG. 1 illustrates an example of a workstation utilizing the system of the present invention.

Referring to FIG. 1, a system or workstation is shown having a mailing machine 10 coupled to a host computer system (or host) 12, such as a personal computer, with a display 12*a*, keyboard or keypad 12*b*, and mouse 12*c*, as typical for interfacing with a personal computer. For example, the mailing machine may be such as described in U.S. patent application Ser. No. 10/941,409, filed Sep. 15, 2004, which is herein incorporated by reference. The computer module (and display) described in this patent application is now provided by host computer system 12, which is coupled by a cable 13 to the electronics of the mailing machine 10. The mailing machine 10 has an envelope separating and transport module 16 for feeding stacked envelopes from surface 15 along a forward path 18*a* onto platform 20 or scale 22, and a back path 18*b* from scale 22 to a printing mechanism or printer 19 (shown as dashed lines), such as an ink jet printer, and for ejection onto a stacking tray 24. Optionally instead of providing scale 22, a separate scale 26 may be provided at the workstation, and the postage manually entered via computer system 12. The scale 22 or 26 may be of the type which is commercially available, as from Metler-Toledo. Separating and transport module 16 has belts, pulleys, and rollers for driving individual envelopes along paths 18*a*,18*b*. The platform 20 has pulleys and belts which drive the letter after weighing, if scale 22 is provided, along back path 18*b*. The printer 19 as well as the weighing operation and the timing of motors and actuators in the transport module 16 are under the control of host computer system 12. A sensor on the scale 22, which may be an optical sensor, detects envelopes falling on the platform 20. This sensor is illustrated as 23 in FIG. 1, but may be located in other locations to detect when to an envelope is present to the host computer system 12. Further, additional or other optical sensor(s) may be provided along path 18*a* and/or path 18*b*, for providing envelope location information.

For example, mailing machine 10 may be model numbers AESP-180 or AESP-180W manufactured by Data-Pac Mailing Corp., Webster N.Y. Although a mailing machine is shown in FIG. 1, any other mailing machines may be used which drives envelopes along a path to a print-head, such as those manufactured by Pitney Bowes Inc., Stamford, Conn., and operated in accordance with the software described below.

Figure 2:
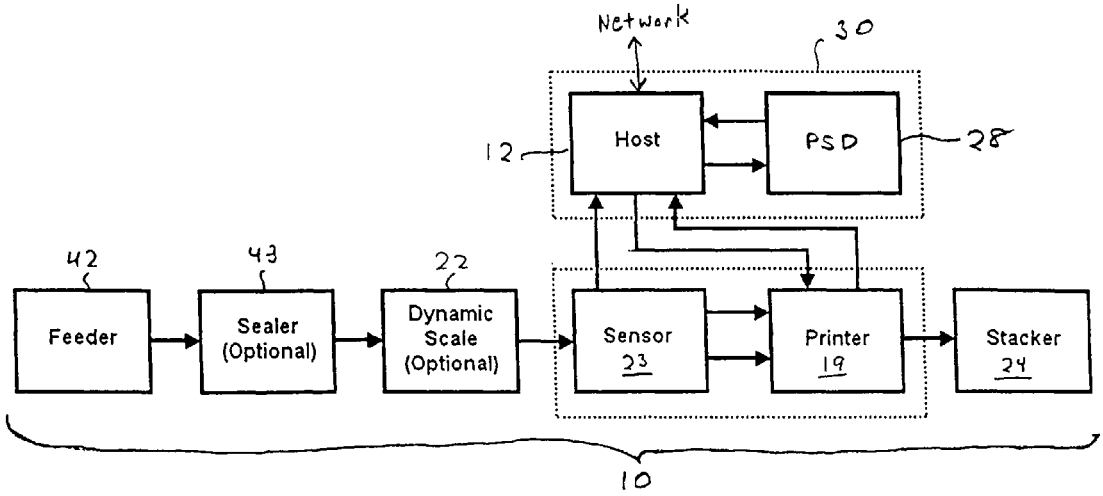
FIG. 2 is a block diagram of the system of the present invention.

Referring to FIG. 2, the host computer system 12 is coupled for data communication with a postage security device (PSD) 28 interfaced with the host computer system in the host housing 30. The PSD 28 represent electronics on two printed circuit boards, a PSD motherboard 28*a* and a PSD board 28*b*, shown in FIGS. 2A and 2B, respectively. The PSD board 28*b* resides on the motherboard where connectors 31*a* and 31*b* mate with each other to enable data communication between boards 28*a* and 28*b*. Connector 31*b* is shown as dashed lines to denote that it is located on the bottom side of PSD board 28*b* when connected to PSD motherboard 28*a*.

The PSD board 28*b* has a microcontroller 36 for controlling the operation of the PSD, volatile memory (or chip) 32 and non-volatile memory (or chip) 34. The microcontroller 36 may represent a Dallas Semiconductor Microcontroller, model no. DS5250, but other types of ATM microcontroller may be used.

Figure 10A:
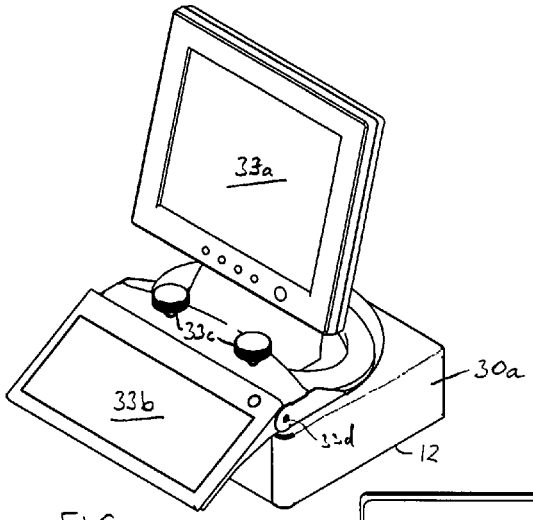
FIGS. 10A, 10B, and 10C are perspective, side, and back views of an example of host computer system of FIGS. 1 and 2 having a housing receiving a PSD, in which in FIG. 10C the PSD is shown prior to insertion of the PSD into the housing.
Figure 10C:
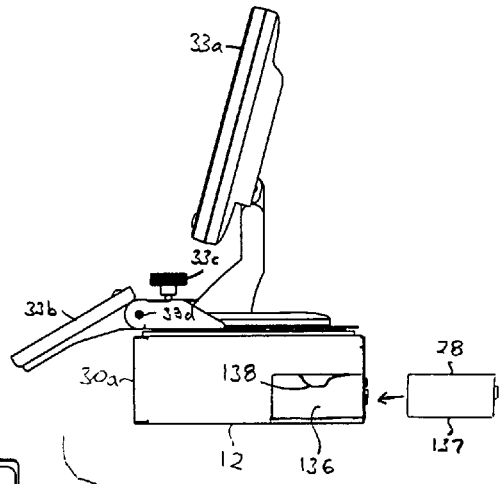

The PSD board 28*b* is installed in a sturdy plastic box and then wrapped with a WL Gore & Associates tamper proof system which includes a sensor for detecting tampering with a plastic wrap (except connector 31*b*) around the box. Once the PSD box has the wrap installed it is then mated to the PSD motherboard. When the wrap sensor detects tampering, an IC chip erases or wipes volatile memory 32. Sometimes such eraser is called zeroization, such that memory 32 is not recoverable. The PSD motherboard 28*a* along with the PSD board 28*b* is preferably installed into a 16 gauge steel box (for e.g., box 137 of FIG. 10C) having an access cover secured with non-reversing fasteners.

Volatile memory 32 (e.g., RAM) includes at least the program code or software for operating microcontroller 36, and a SHA-1 HMAC signature algorithm utilizing a secret key to produce a cryptographic keyed-Hash Message Authentication Code (HMAC), such as described in FIPS PUB 198, issued by the U.S. Dept. of Commerce. Other data stored in memory 32 are the secret keys of the PSD, and at least an Indicia Version Number, Vendor number, and PSD Model number, as described later below.

Non-volatile memory 34 (e.g., RAM) has an ascending register, a descending register, and a piece or cycle counter. The ascending register records the amount of postage funds expensed. The descending register records the amount of postage funds available. The cycle counter is the number of pieces (e.g., envelopes or items) processed by the PSD. Non-volatile memory 34 also stores information which is set at time of manufacture/installation, including at least postage type, origin zip code, PSD serial number, and a user identifier (ID). The postage type is a one byte value indicating whether the postage type is real or not real, in operation the byte is set to 0 to indicate real value. The byte may be set to 1 during manufacture and testing. The origin zip code is a three byte value representing a five digit number identifying the U.S. Zip code where the PSD, and the mailing machine (or printer of FIG. 5A or 7) utilizing such PSD, may be used. The user ID is a three byte value representing a seven digit account number for the owner of the PSD.

The PSD motherboard 28*a* communicates with the host computer system 12 (FIG. 2) via a 9 pin connector 38*a* and/or USB connector 38*b* to an appropriate connector(s) of the host computer system 12, such connection also provides power to the PSD motherboard 28*a* and PSD board 28*b*, via connectors 31*a* and 31*b*. Power regulation circuitry 40 may be provided on PSD motherboard 28*a*. Backup batteries 39*a* and 39*b* are also provided on boards 28*a* and 28*b*, respectively, if needed. Circuitry 37 is provided on the PSD board 28*b*. IC 37*a* represents an interface chip for communication protocol conversion between USB to RS-232 in order to facilitate communication between either the host computer system 12 (FIG. 2) or reset computer system (FIG. 6) and the microcontroller 36, which send/receives data in RS-232. IC 37*b* represents a RS-232 converter chip into TTL logic data, which is used during manufacture for installing (e.g., downloading) the firmware (e.g., PSD operating program or code) into PSD board memory 32 and/or 34 from/to a port on IC 37*b* via a cable to a connector 41 on the PSD motherboard 28*a*. Sometimes this operation is referring to as bootloading. After such installation, the cable between IC 37*b* and connector 41 is removed, and the port of the IC 37*b* is locked with a password. In addition to connector 41 being used to interface to a computer system at time of manufacture to load the firmware, it also can be used when PSD is returned to manufacturer to read out the non-volatile memory 34. Crystal 37*c* provides a real time clock for date and time, and crystal 37*d* provides a clock for the microcontroller 36. The chips 37*e* are specified by the WL Gore & Associates tamper proof system described earlier, and connect via connector 37*f* to the sensor on the wrap to detect tampering. Such IC's 37*e* program the zeroization described earlier. The LED shown on the motherboard 28*a* indicates whether power to the PSD is ON/OFF. Also, although the microcontroller 36 and memory 32 and 34 are shown on the front side of the PSD board 28*b*, they may be located on the backside of the board.

Figure 2A:
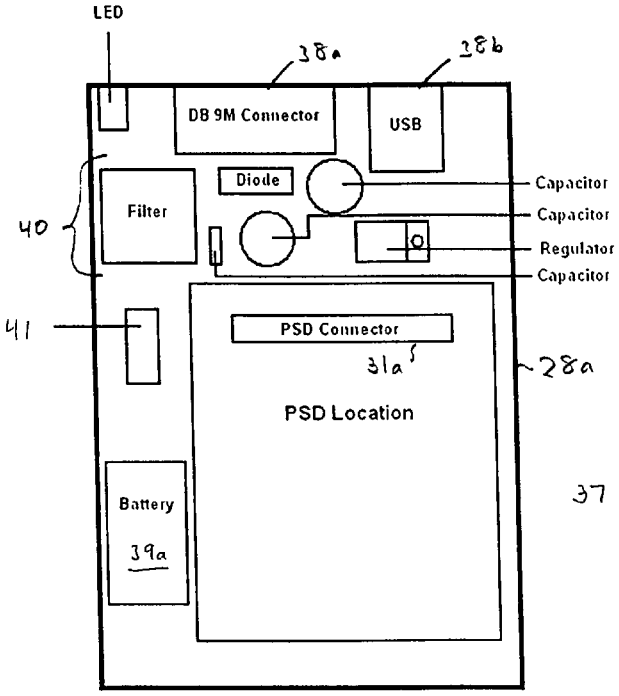
FIG. 2A is a block diagram of PSD motherboard in the system of FIG. 1.
Figure 2B:
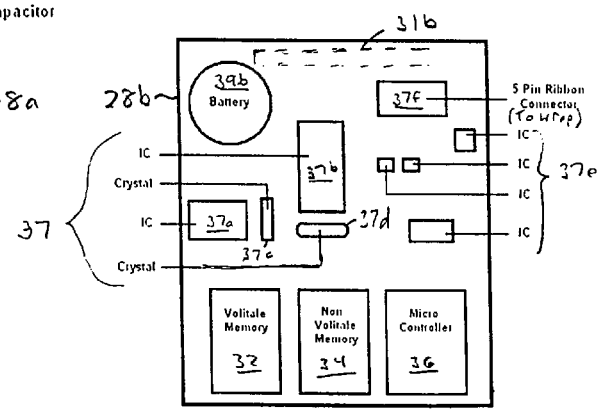
FIG. 2B shows a block diagram of PSD board in the system of FIG. 1 which connects to the PSD motherboard of FIG. 2A.
Figure 10B:
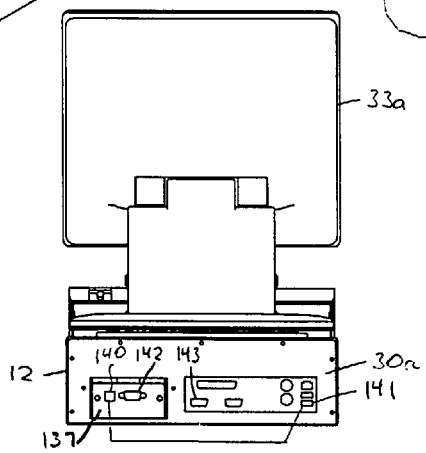

The PSD electronics shown in FIG. 2A and FIG. 2B are exemplary, as other electronics may be used to provide similar functionality. For example, the PSD 28 may be component internal or external of the host computer system 12 having an interface to host computer system 12, a microcontroller (or microprocessor), and memory with contents of memory 32 and 34 as detailed above to enable the microcontroller to provide PSD operation as described herein. Preferably, the PSD is in a self contained unit adapted to be received in the housing 30 of host computer system 12, such as shown for example in FIGS. 10A, 10B, and 10C. In these figures, PSD 28 is contained in a box (or unit) 137 which is received in a cavity or opening 136 in housing 30*a* of the host computer system 12, and retained in the cavity by spring clip 138. Data communication between the host computer system 12 and the PSD 28 is provided by a cable connecting PSD connector 140 with host computer connector 141. Power to the PSD and host computer system may be supplied via power cords to sockets 142 and 143, respectively, which if needed, may have typical AC power adapter.

The host computer system 12 in such housing 30*a* configuration further has a display 33*a* and touch keyboard 33*b* on an assembly rotatable along the top of housing 30*a*, in which knobs 33*c* turn to lock and unlock the assembly's rotational position with respect to housing 30. Thus, the user interface of the display 33*a* and keyboard 33*b* can be rotated by the user as needed for ease of the user to access the user interface. This feature is desirable when housing 30*a* is mounted on a mailing machine such that the user can vary the user interface with respect to his or her position to control and/or monitor system operation. Also, the keyboard 33*b* may be pivotable upward and downwards along flanges extending to a shaft 33*d* along each side of the keyboard. For example, the housing 30*a* may be compact having a length of about 10 inches, a width of about 12 inches, and a height of about 3.75 inches. However, other dimensions may be used. Less preferably, the PSD 28 is located outside the housing of host computer system 12.

Referring back to FIG. 2, mailing machine 10 is representing by a feeder 42, sealer 43, scale 22, sensor 23, printer 19, and stacker 24. The parallel arrows between the blocks illustrating components 42, 43, 22, 23, 19, and 24 illustrate the path of each envelope through the machine. The remaining arrows above blocks 19 and 23 represent data communication. The feeder 42 represents the first part of separating and transport module 16 along path 18*a*. The sealer 43 may be a typical sealing module not shown in FIG. 1, but available from Data-Pac of Webster, N.Y. The host computer system 12 also has typical hardware/software for enabling interface with a network, such as Internet and/or LAN.

Figure 3:
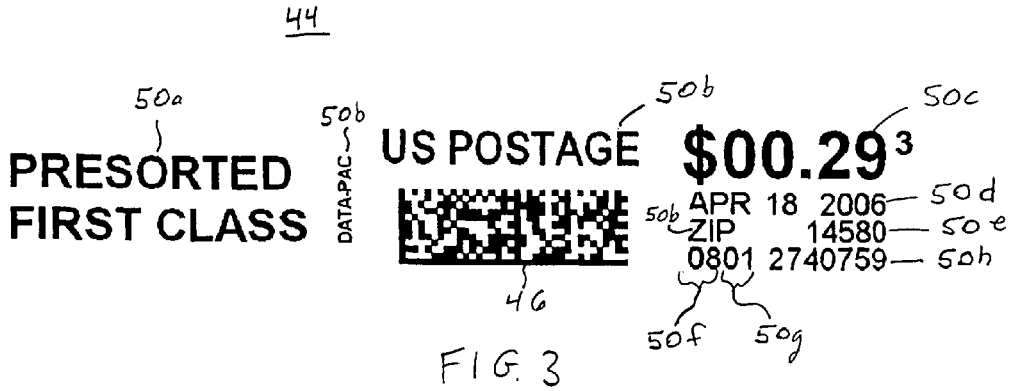
FIG. 3 is an example of printed indicia on an envelope or label having IBI Lite barcode and image/text human readable information.

FIG. 3 illustrates an example of the postage indicia 44 having an IBI Lite barcode 46, and human readable image/text data 50. Data 50 may represent class of service 50*a*, static text 50*b*, postage value 50*c*, the date indicia 44 was printed 50*d*, zip code 50*e*, vendor ID 50*f*, Model ID 50*g*, and PSD Serial Number 50*h*. Data 50*b*, 50*e*, 50*f*, 50*g*, and 50*h* are stored in memory of the host computer system 12 at time of manufacture/installation, in which data 50*e*, and 50*h* are fixed for a given PSD 28. Data 50*a* may be preset or selectable by the user at the host computer system 12 at the start of a transaction in accordance with the mailing item(s) or envelope(s) to be processed. Human readable image/text data is preferably printed at 300 dpi.

The IBI Lite barcode 46 represents 20 bytes of data as shown in the following table.

| Field Order in Indicia | IBI DD Field Reference Number | Field Length | Indicia Offset | Data Elements | Fixed Value |
|---|---|---|---|---|---|
| 1 | 11 | 1 | 0 | Indicia Version Number | 0 |
| 2 | 30 | 4 | 1 | Piece Counter | |
| 3 | 35 | 1 | 5 | IBI Vendor/Model | 129 |
| 4 | 36 | 3 | 6 | PSD Serial Number | |
| 5 | 15 | 3 | 9 | Postage Value | |
| 6 | 37 | 2 | 12 | Intelligent Mail Service | |
| 7 | | 6 | 14 | HMAC Message Digest | |
| Total Bytes | | 20 | | | |

Indicia Version Number represents real postage prints as 0, and is stored in memory of PSD 28. The Piece Counter is the current value of the piece counter in memory of PSD 28. IBI Vendor/Model 50*f* and 50*g*, e.g., 0801 indicating vendor number 8, PSD Model number 1, is also stored in memory of PSD 28. The Intelligent Mail Service (IMS) Number represents a code indicating the USPS intelligent mail services (if any) that have been applied to the mail piece. The HMAC Message Digest represents the first 6 Bytes of a 20 byte HMAC determined by the PSD in response to a postage request from the host computer system, as will be described below in connection with FIGS. 4A-B.

In operation of the mailing machine 10, when the host computer system 12 first connects with the PSD 28, the host computer system sends a request to the PSD for its status information. In response, the PSD sends to the host computer system its PSD Serial Number, and values of its ascending and descending registers, and cycle counter, and the User ID. The host computer system, which stores in its memory at least the PSD Serial Number and User ID, verifies that the PSD is proper by checking that this number matches the PSD Serial Number and User ID returned from the PSD. If these two values do not match, the mailing machine 10 will not operate. The origin zip code may also be read from PSD, and similarly used to verify the PSD by checking that the read zip code matches the origin zip stored in memory of the host computer system. The host computer system 12 has a graphical user interface (using 12*a,b,c*) enabling the user of mailing machine 10 to input either a preset postage value for each envelope to be processed, or select to weigh each envelope automatically on the scale 22 and determine the postage value of each piece individually based on weight and class of service. The graphical user interface may also display the current value of the descending register, or other information typical of a mailing machine. The graphical user interface also enables the user to assign an account number to be associated with the transaction, such as for billing or accounting purposes. Each transaction represents one or more envelopes processed by the host computer system under an account number. Once inputted, the operation of the mailing machine is as shown in FIGS. 4A-B.

Figure 4A:
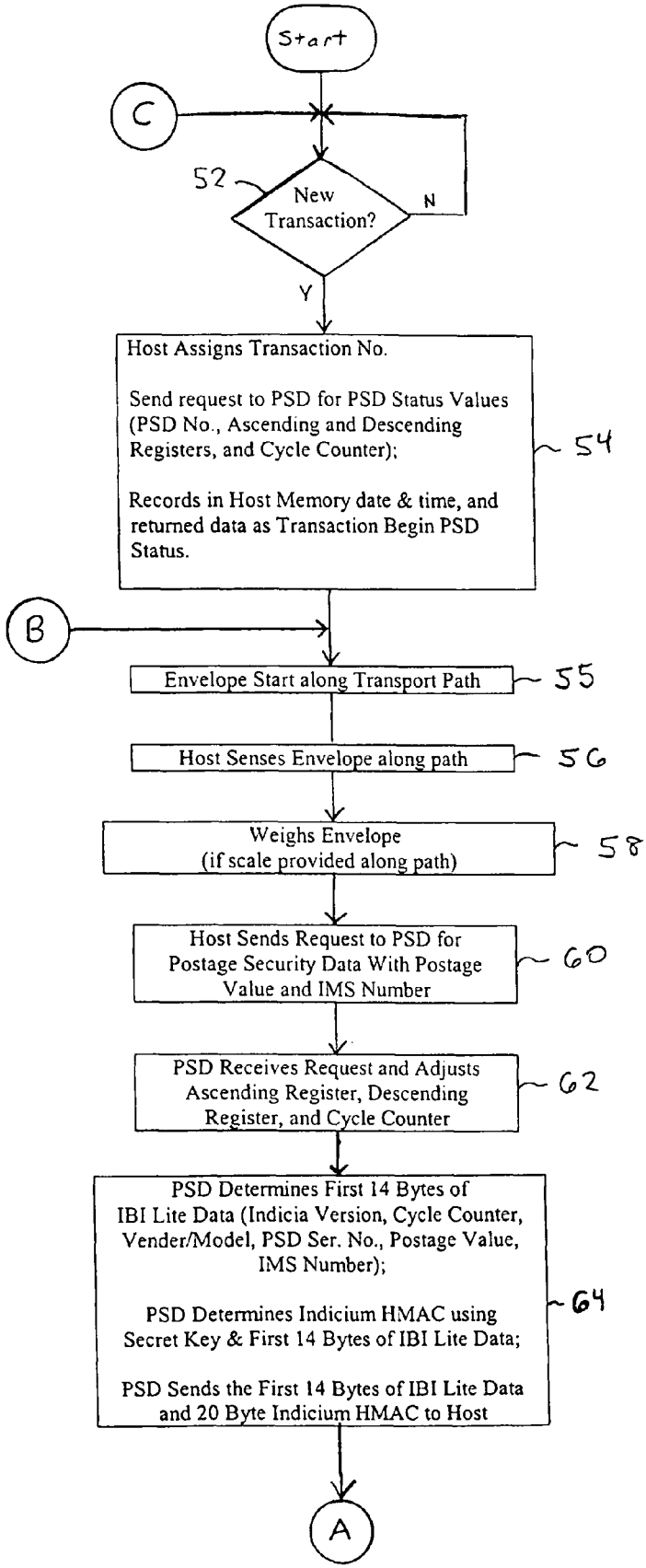
FIGS. 4A and 4B is a connected flowchart of the operation of the system of FIGS. 1 and 2.
Figure 4B:
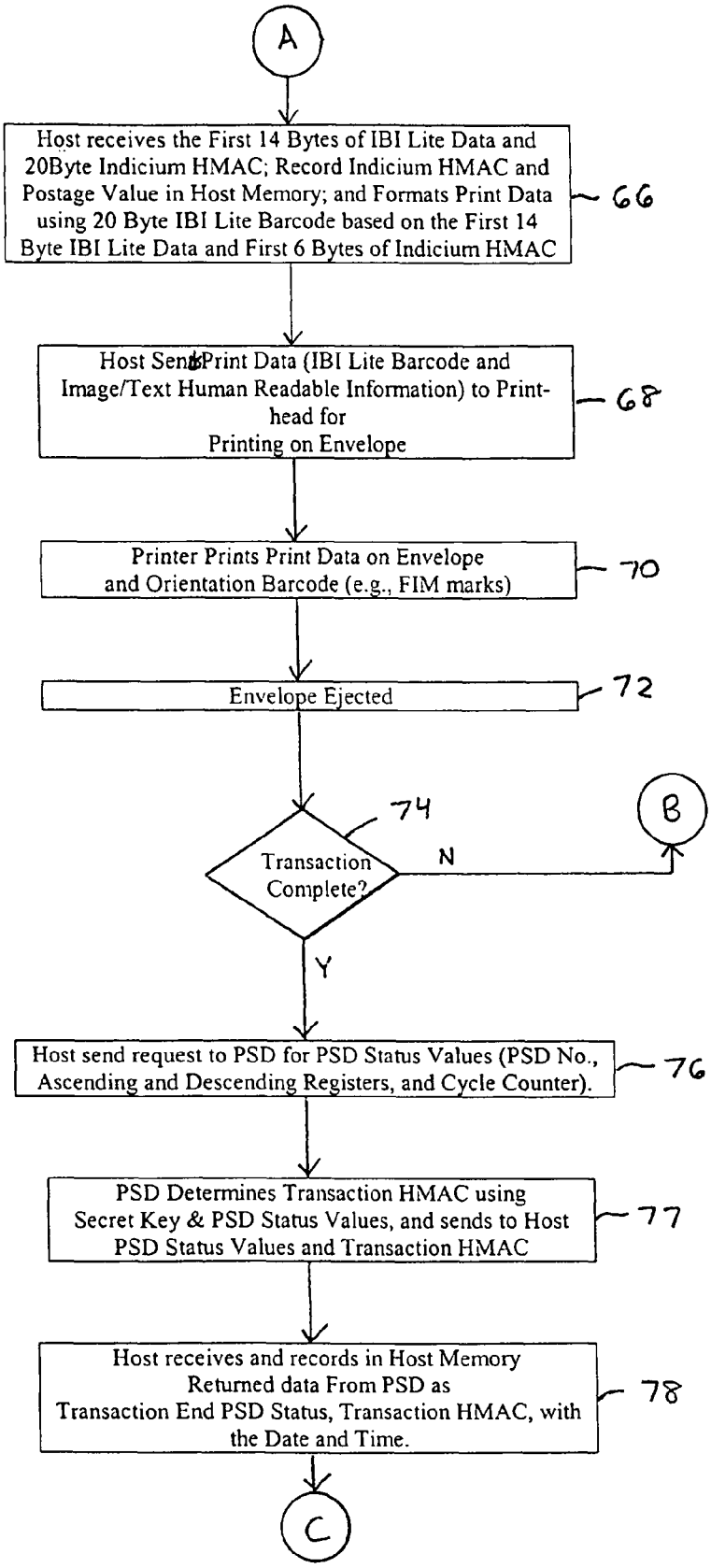

Referring to FIGS. 4A-B, the host computer system 12 determines first if this is a new transaction (step 52). If so, the host computer system assigns a transaction number, sends a request to PSD for PSD status values (i.e., PSD serial no., ascending and descending registers, and cycle counter), and records in its memory, the current date and time, and the returned PSD status values as Transaction Begin PSD Status (step 54). As typical of a computer system, the host computer system 12 has a clock which maintains the current date and time. Each time a new account number is entered by the user, a new transaction occurs.

When the envelope start along transport path 18*a* (step 55), the host computer system senses the envelope with sensor 23 (step 56), and then weighs the envelope, if scale 22 is provided and selected by the user (step 58). The host computer system 12 then sends a request to PSD for postage security data (i.e., HMAC) with the postage value and the IMS Number for the envelope (step 60). A zero IMS Number may refer to there being no intelligent mail services being applied to the piece. However, the user may select intelligent mail services via the graphical user interface of the host computer system, and as such the IMS Number has a value corresponding to such intelligent mail services selected. For example, the IMS Number may specify that the envelope is a certified letter, and such coding to identify that letter requires special treatment by the U.S. Post Office. Thus, the IMS Number is useful for automatically machine sorting of mail by the U.S. Post Office. If the postage value was inputted by the user, this is the postage value sent to the PSD 28. In response to the request, the PSD adds the postage value to the ascending register, subtracts the postage value from the descending register, and increments the cycle counter by one (step 62)

Next at step 64, the PSD determines the HMAC for this particular envelope. First the PSD determines the first 14 Bytes of the IBI Lite Data, such as shown in the above Table. The PSD now has all of this information since the postage value and IMS number was provided by the host computer system, and the Indicia Version, Cycle Counter, Vendor and Model Numbers, and PSD Serial Number are available from PSD memory. The first 14 Bytes (Indicia Version, Cycle Counter, Vendor/Model, PSD Ser. No., Postage Value, and IMS Number) is inputted to the SHA-1 HMAC algorithm executed by the PSD, as prescribed by FIPS PUB 198, using the secret key in memory 32 to determine a 20 byte HMAC security code ("Indicium HMAC") for this envelope. The PSD then sends the first 14 Bytes and the 20-byte Indicium HMAC, 34 bytes in all, to the host computer system.

The host computer system at step 66 receives the 34 bytes, of which the first 20 bytes comprise the entire IBI Lite Data to be printed as a barcode on the envelope. As such, of the 20-bytes Indicium HMAC only a subset of six bytes thereof are extracted (or pre-designated) for use in the last field of the IBI Lite Data as shown in the above table, and the other fourteen bytes of the HMAC are not used in the IBI Lite Data. Having the entire 20 Byte IBI Lite Data, the host computer system formats print data for printing as a barcode (e.g., 46—FIG. 3) by the printer 19 along with image/text 50 (e.g., see FIG. 3) from memory of the host computer system. The host computer system records piece data for the transaction in its memory by storing at least the first 6 Bytes (or the entire 20 Bytes) of the Indicium HMAC returned from the PSD for the envelope, and the postage value.

The host computer system 12 sends the print data to printer 22 for printing on the envelope when the envelope is presented to the printer (step 70) and the envelope then is ejected by the mailing machine (step 72). Preferably each envelope is processed in approximately 0.25 seconds or less.

The host computer system 12 then determines if the transaction is complete (step 74), by checking if the user via the graphical user interface has selected to stop the transaction, or entered another account number, or other conditions, if desired, such as preset idle time when no mail is processed by the machine. If the transaction is not complete, the process branches to step 55, and the next envelope is processed through the machine. If the transaction is complete, the host computer system sends a request to the PSD for PSD status values (i.e., PSD Serial No., Ascending and Descending Registers, Cycle Counter) and a unique security code 20-byte HMAC ("Transaction HMAC") based on such PSD status values (step 76). The PSD determines the Transaction HMAC using the secret key and the current PSD status values using SHA-1 HMAC algorithm (step 77). The host computer system receives the PSD status values and Transaction HMAC from the PSD, and records the returned values as Transaction End PSD Status, Transaction HMAC, with the Date and Time (step 78). After step 78, the process branches back to step 52 and waits for the next transaction. Optionally a second printer may be provided in machine 10, such that at step 70 the second printer's print head when disposed with respect to the envelope prints orientation lines, such as FIM marks.

In another embodiment, the host computer system 12 may print postage indicia on labels or media, which may be adhesive backed, without mailing machine 10. This embodiment is shown in the block diagram FIG. 5A, in which the host computer system 12 and PSD 28 in housing 30 is connected using typical hardware/software to a typical printer 80, via cable, wireless RF, or LAN. Printer 80 has media, such as adhesive-base label sheets. The printer 80 may also represent a specialized printer for printing labels. The printer operates responsive to print data from the host computer system 12 as typical of a computer system to an output rendering device. Although not shown in FIG. 5A, the host computer system 12 has display, keyboard, mouse, and/or other input/output devices as typical with personal computers.

Referring to FIG. 5B, the operation of computer system 12 with printer 80 is shown. A user interface, such as described earlier, enables the user to enter an account number and postage value, such as provided by the user weighing an envelope or package on postal scale 26. The interaction between the host and PSD of steps 82, 83, 84, 85, 86 are the same as steps 54, 60, 62, 64 and 66, respectively, as described earlier. However, at step 88 the host sends the print data (IBI Lite barcode 46 and Image/Text 50) to printer 80 and the printer then prints the postal indicium in accordance with such print data onto media (e.g., paper, adhesive backed label), or even on an envelope, or card, which is properly oriented for feeding through the printer (step 90). If the user instructs the host computer system, via the user interface, to print multiple postal indicia, steps 83-90 are repeated, otherwise, steps 92-94 are performed the same as step 76-78 described earlier.

Figure 7:
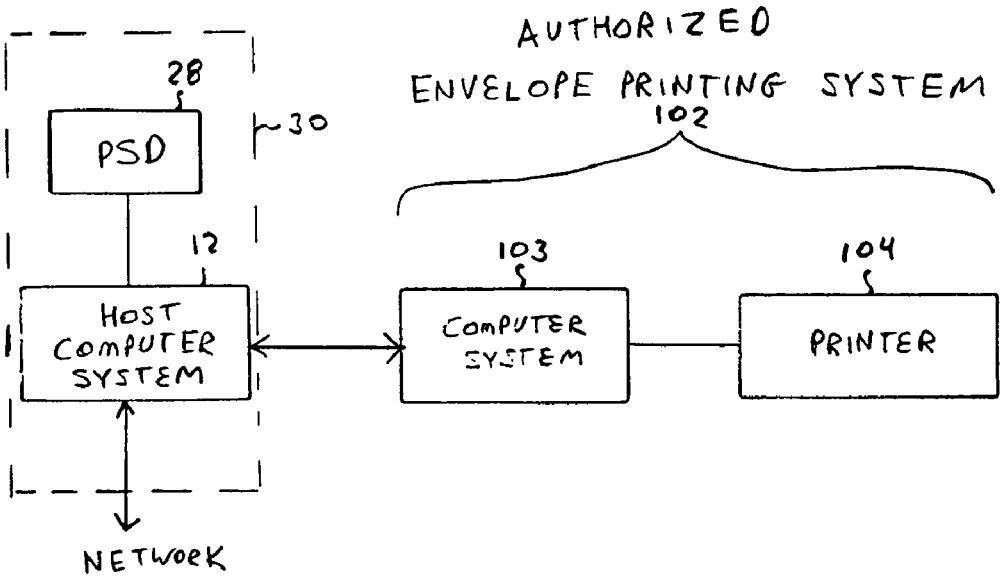
FIG. 7 a block diagram of a further embodiment of the present invention using an authorized envelope printing system, rather than the mailing machine of FIG. 1, or printer of FIG. 5A.

A further embodiment is shown in FIG. 7, in which the host computer system 12 is interfaced with an authorized envelope printing system 102 having a computer system 103 connected to a printer 104 which prints information received from computer system 103 on individual envelopes or other mailing items driven through printer 104. Interfaces and drivers (hardware and software) are provided on host computer system 12 and computer system 103 to enable data communication there between, via cable, wireless RF, or LAN. For example, printer 104 may be an Envelope Imager, such as manufactured by RENA Systems, Inc., of Oaks, Pa., which can be operated responsive to data from computer system 103, but printer 104 may be any other printer which enables printing (or imaging) on envelopes or other mailing items. Computer system 103, like host computer system 12, may be a personal computer with a typical operating system. Although not shown in FIG. 7, the host computer system 12 and computer system 103 has a display, keyboard, mouse, and/or other input/output devices as may typically be used with personal computers.

For example, computer system 103 coupled with printer 104 may represent an addressing system which, in accordance with software running on computer system 103, enables printing of addresses by printer 104 using address information stored in a database of memory (e.g., hard drive) of computer system 103 (or memory accessible to computer system 103 such as optical/magnetic media via an optical/magnetic drive of system 103, a external memory storage device, or port of computer system 103). Such addressing systems may be such as used for printing addresses on direct or bulk mail items, along with other print data or information, such as postal indicia, return addresses, logos, barcode addresses, and the like, in accordance with user input via graphic user interface (e.g., mouse, display, keyboard) utilizing the software on system 103. For example, software for operating computer system 103 to provide such addressing system is available from RENA Systems, Inc., but any other software for applying printed matter on mailing items using a printer may be used. In the present invention, such addressing system is improved to provide authorized envelope printing system 102, where computer system 103 has additional software enabling interactive operation with host computer system 12 so that computer system 103 can send messages requesting postage indicia to host computer system 12, receive print data representing such postage indicia from host computer system 12, and then directs the printer 104 to print postage indicia on envelopes or other mailing items along with other print data, such as addresses or other information, as desired by the user in accordance with software on computer system 103.

Figure 8A:
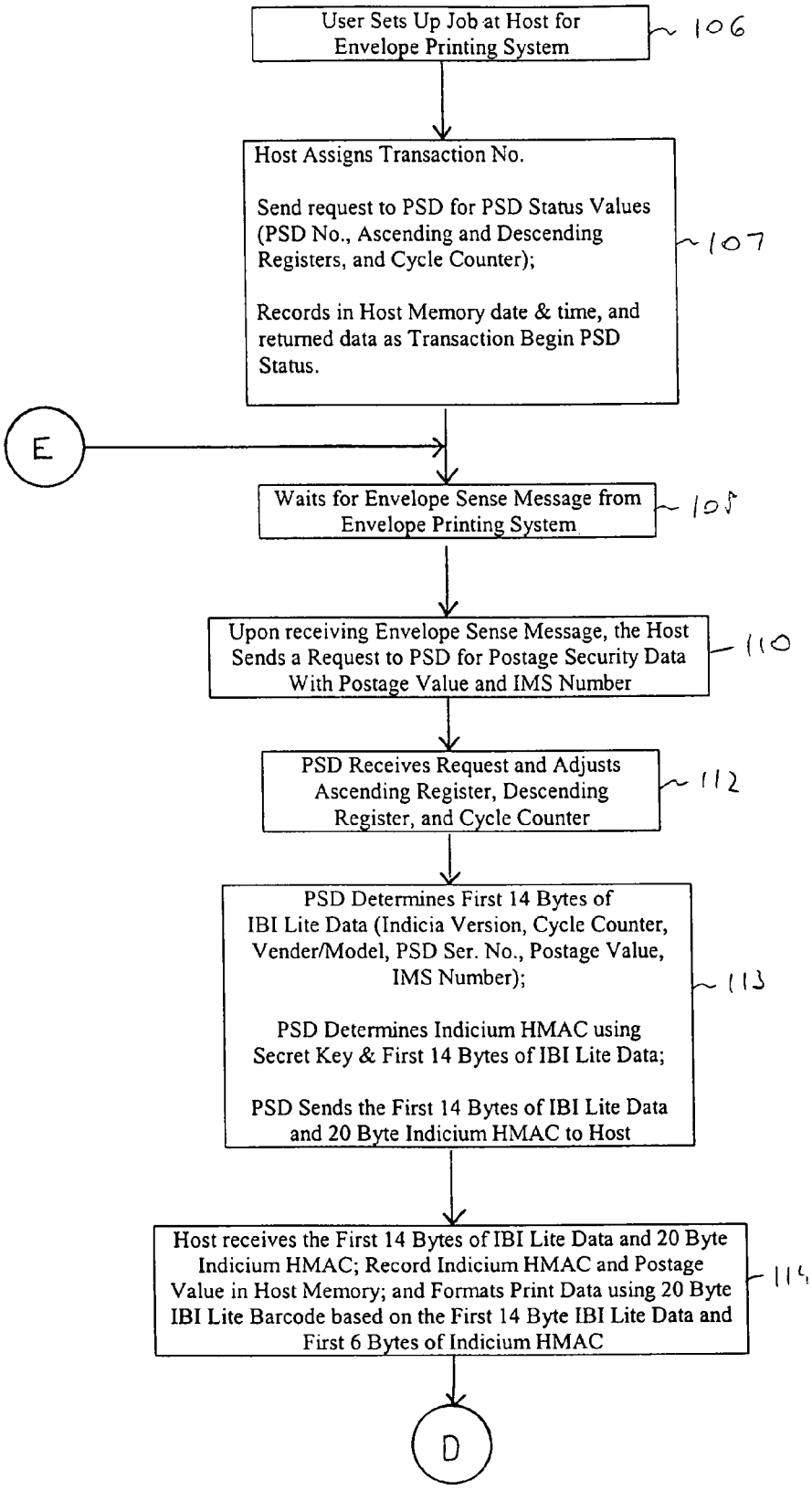
FIGS. 8A and 8B is a connected flowchart showing the operation of the host computer system of FIG. 7.
Figure 8B:
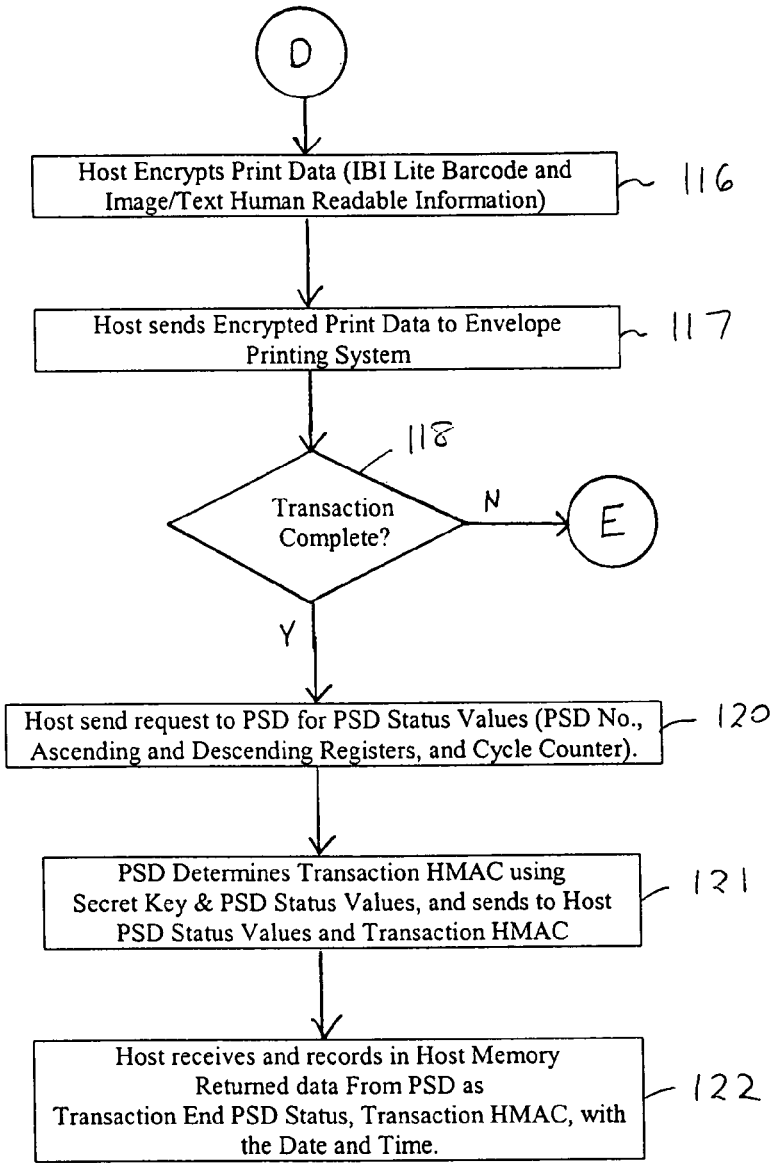

Referring to FIGS. 8A-8B, the operation of host computer system 12 with authorized envelope printing system 102 is shown. A user interface of host computer system 12 enables the user to enter an account number and postage value, such as provided by the user weighing an envelope on postal scale 26, or as otherwise known for the weight and/or class of each successive mailing item to be processed at printer 104. The interaction between the host computer system 12 and PSD 28 of steps 107, 110, 112, 113, 114 are the same as steps 54, 60, 62, 64 and 66, respectively, as described earlier. However, after step 107, the host computer system 12 waits for an envelope sense message at step 108, and proceeds with steps 110, 112, 113, and 114 after receiving an envelope sense message from computer system 103. After step 114, the host computer system 12 encrypts the print data (IBI Lite barcode 46 and Image/Text 50) (step 116) and then sends the encrypted print data to computer system 103 (step 117). The host computer system 12 and computer system 103 each have data encryption/decryption software such that data encrypted by host computer system 12 can be decrypted by computer system 103, and vice versa, if desired. Preferably, such encryption/decryption software is provided by Triple DES, such as described in FIPS PUB 46-3, with secure keys provided in memory of computer systems 12 and 103 to enable encryption/decryption. Use of encryption/decryption algorithms assures that the envelope printing system, and in particular computer system 103, is authorized to operate with host computer system 12 and its PSD 28. However, other data encryption/decryption algorithms may be used, and less preferably, print data may be sent to computer system 103 without encryption, and thereby requiring no decryption on part of computer system 103.

The host computer system 12 then determines if the transaction is complete (step 118), by checking if the user via the graphical user interface of host computer system 12 has selected to stop the transaction, or entered another account number, or other conditions, if desired, such as preset idle time when no mail is processed by the system 102, or that a predetermined number of mailing items have been processed (such as inputted via the user interface of computer system 12 or 103). If the transaction is completed, steps 120, 121, and 122 are performed the same as step 76-78 described earlier, otherwise, the host computer system 12 returns to step 108 to wait for the new envelope sense message from computer system 103.

Figure 9:
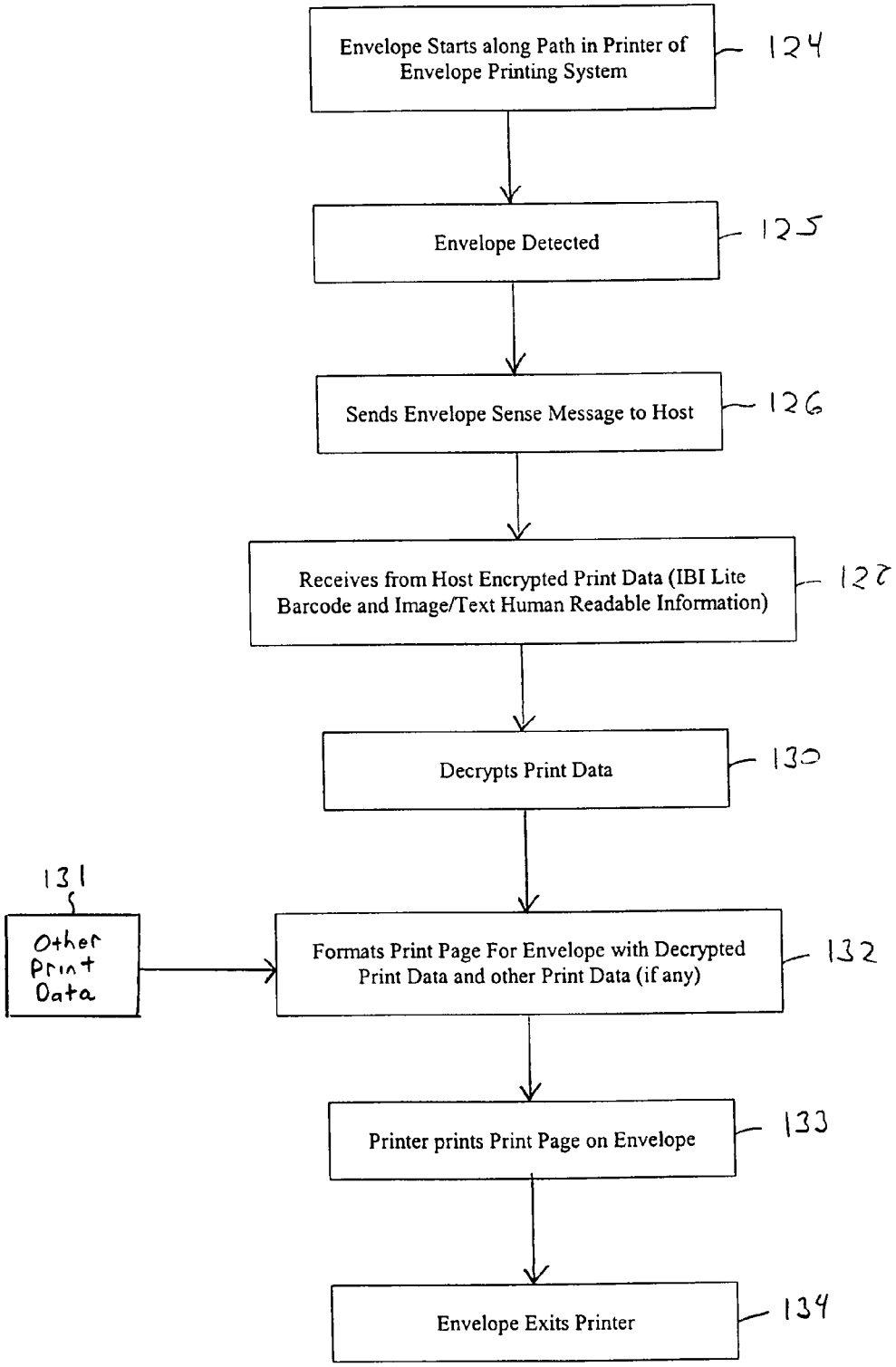
FIG. 9 is a flowchart of the operation of the authorized envelope printing system of FIG. 7.

Referring to FIG. 9, the operation of authorized envelope printing system 102 is shown. The envelope starts also the path of printer 104 (step 124). After detection of an envelope (step 125) an envelope sense message is sent to host computer system 12 (126). The computer system 103 sends the envelope sense message in response to either a signal from the printer 104, or at such time when computer system 103 sends a start signal to printer 104 to actuate a motor for feeding each envelope. If a signal is received from computer system 103 from the printer 104, such may be from the printer 104 electronics in response to a detection signal from an mechanical/optical sensor(s) along the transport path of envelope (such as provided by motor driven belts, wheels, or pulleys, or the like) toward printer's print head elements, or such other internal signal of the printer electronics. If needed to provide a detection signal, a mechanical or optical sensor may be provided along the transport path to provide such signal to a port of the computer system 103. The envelope sense message is sent to the host computer system 12, such that by the time the envelope is present at the printer's print head (or printing elements), computer system 103 has received the postage indicia from the host computer system 12, and sent it along with other print data to the printer 104 to actuate the print head accordingly.

The computer system 103 waits to receive from host computer system 12 the encrypted print data (IBI Lite barcode 46 and Image/Text 50) from step 116 of FIG. 8A (step 128), decrypts such print data (step 130), and formats a print page for the envelope with the decrypted print data as postage indicia along with other print data 131, if present, per software on computer system 103. In the case of authorized envelope printing system 102 representing an addressing system, other print data 131 may be an address (such as from address database), and/or return addresses, logos, barcode address, FIM lines, or any other user defined printed information set up at computer system 103 to be present on each envelope. The term, print page, presents a page or area associated with the size of the envelope or other mailing item onto which printing will take place. At step 133, the printer 104 using its print head or elements prints an image of the print page on the envelope when it is presented to such print head or elements, and the envelope exits the printer (step 134). Steps 124-134 are repeated for each envelope until the transaction is complete at step 118 of FIG. 8B.

In the case of the mailing machine 10, printer 80 or printing system 102, transaction data is stored in memory of the host computer system 12 for each transaction, e.g., a transaction number, Begin PSD status, End PSD status, Begin Date and Time, and End Date and Time, including the Transaction HMAC, and information about each mail piece processed, e.g., indicium HMAC (all or first 6 bytes) and postage value for each mail piece. The transaction data is uploaded to a reset computer system, via a network, which provides a repository (or archive storage) for all transactions processed by a particular PSD, as shown in FIG. 6.

Figure 6:
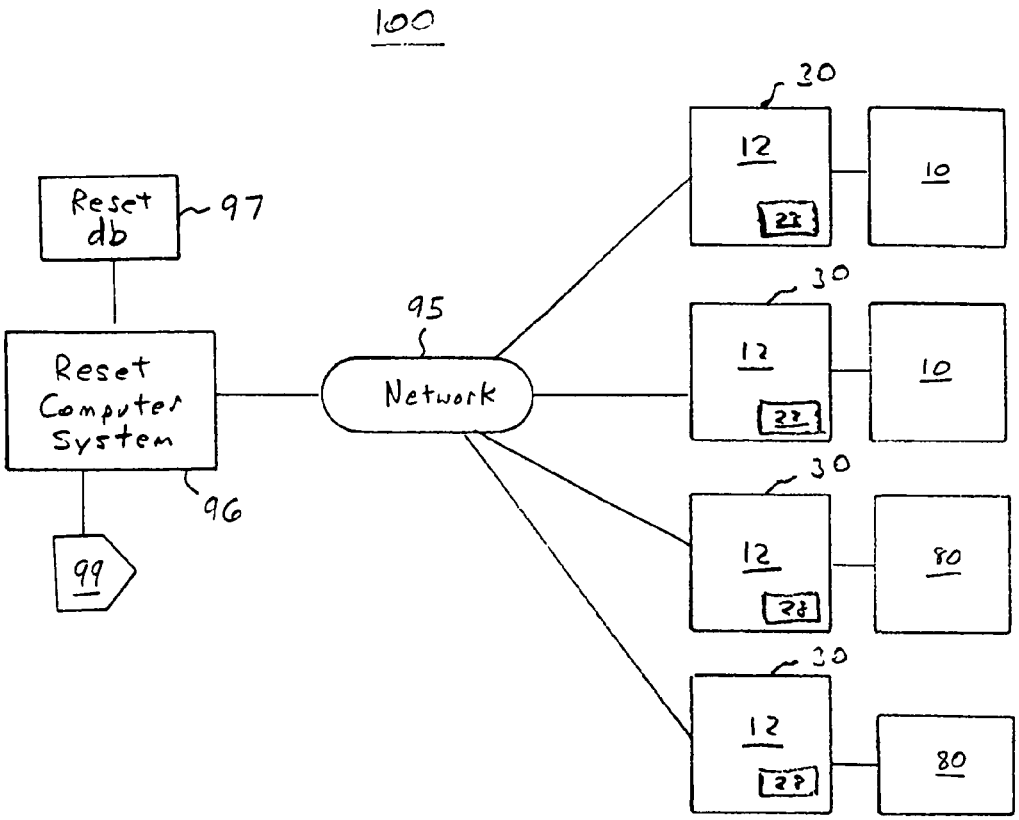
FIG. 6 is block diagram of an accounting and evidencing system utilizing multiple host computer systems and their associated PSD's.

Referring to FIG. 6, a system 100 is shown having a plurality of host computer system 12, each with a PSD 28, connected to a plurality of the mailing machines 10 or printers 80. Although not shown, one or more the host computer systems of FIG. 6 may be connected to printing system 102. Each PSD 28 has a different unique PSD serial number, and two unique secret keys stored in memory 32. The first key represents the key used to provide the Indicium and Transaction HMACs, as described above, and the second key is used for verifying transmissions from a reset computer system or server 96. The host computer systems 12 associated with the mailing machines 10 or printer 80 (or printing system 102) can connect with the reset computer system 96 which can communication to each PSD associated with mailing machines 10 or printer 80 (or printing system 102), over a network 95, via the host computer system, using typical networking communication protocol. The reset computer system 96 also stores in its memory the two unique secret keys of each of the PSDs 28 in system 100. For example, network 96 may represent the Internet. The reset computer system 96 may be a typical network computer server, and each of the host computer system 12 has typical hardware/software for communicating at network address associated with the computer server when a network connection is desired. For example, the host computer system 12 may have a modem to a cellular or PSTN, or other network connection, such as DSL, cable, or other broadband connection. The number of host computer systems shown in FIG. 6 is illustrative, any number of host computer systems may be used and may communicate with reset computer system over the same or different networks. Also, optionally a host computer system 12 may be connected for data communication to one or more of a mailing machine 10, a printer 80, or printing system 102, if desired.

A reset database 97 is provided in a memory storage unit, e.g., optical disc drive, of the computer system 96, and thus a part of such computer system. Alternatively, the reset database may be a separate memory storage unit, such as an external drive or memory of another computer system accessible to the reset computer system 96. The reset database 97 maintains an account for each user and the amount of postage funds which the user has deposited in such account. The reset database also maintains PSD history for each PSD 28 in system 100.

When a user at a host computer system 12 requires more postage at their PSD 28, the graphical user interface of the host computer system enables the user to request addition of a particular postage amount, and the host computer system then sends a request to its PSD 28 to add such amount. In response, the PSD 28 connects the reset computer system 96, via host computer 12 and network 95. The host computer system 12 then transmits (uploads) to the reset database 97, via the reset computer system 96, the PSD Status (Ascending Register, Descending Register, Cycle Counter, and unique security code 20-byte Transaction HMAC) when each transaction was processed by the host computer system since the last connection with the reset system. This information is provided in accordance with the stored transaction data in memory of the host computer system. For example of a two envelope (I) and (II) transaction, the transaction data stored in the host computer memory may represent the following data:

Transaction Identifier; Account Number
Begin—PSD SER. NO.; ASC. REG1; DESC. REG1; CYC. CTR1; DATE AND TIME1
POSTAGE VALUE I; Indicium HMAC I
POSTAGE VALUE II; Indicium HMAC II
End—PSD SER. NO.; ASC. REG2; DESC. REG2; CYC. CTR2; DATE AND TIME2
Transaction HMAC (unique 20-byte security code)

The upload to the reset database for the transaction of this example would be:

PSD SER. NO.; ASC. REG1; DESC. REG1; CYC. CTR1; DATE AND TIME1.
PSD SER. NO.; ASC. REG2; DESC. REG2; CYC. CTR2; DATE AND TIME2.
Transaction HMAC (unique 20-byte security code)

Upon receiving the uploads the reset computer system 96 stores it in reset database 97 in accordance with the PSD serial number. In this manner, the status of the PSD 28 at a start date and time and end data and time, and Transaction HMAC of every transaction is stored in the reset database 97, which maintains a repository of such information for evidencing purposes. Also, for accounting purposes, such data as to the status of descending and ascending registers can be checked for errors with funds previously provided to the descending register of the PSD. The upload of transaction data occurs each time the PSD communications with the reset computer system 96, regardless of whether funds are requested. Other data structures than shown above may also be used in storing and uploading transaction data.

After the upload for each transaction since last connection is complete, a funds transfer process occurs in which the PSD 28 and reset computer system 96 send SHA-1 HMAC-signed, messages between each other, in which messages sent from the PSD to the reset computer system are signed by the PSD using the first secret key of the PSD, and message sent from the reset computer system are signed by the reset computer system using the second secret key of the receiving PSD. The reset computer system and PSD use the same SHA-1 HMAC algorithm and such signing/verifying provides a level of data communication security.

The PSD 28 using the first key signs a request for funds specified by the user to the reset computer system 96. The reset computer system 96 using the first key for the PSD stored in its memory verifies the PSD message authenticity. If the PSD message is authenticated, the reset computer system using the second key for the PSD stored in its memory signs a message to the PSD to instruct the PSD to add funds. The PSD using the second key in its memory authenticates the message, and if authenticated, add the funds to its descending register. The PSD then sends a verification message signed using its first key back to the reset computer system, and the reset computer system using the first key in its memory verifies the PSD message authenticity, and if authenticated subtracts that amount of funds from the user's account, and the connection between the PSD and the reset computer system terminates.

The evidencing operation is performed as follows for a print indicium to determine if the print indicium is authentic or fake using the IBI Lite barcode. The 20 bytes of the IBI Lite indicium being analyzed are input to the reset computer system 96 either by scanning the barcode or by manual entry. The reset computer system parses the 20 bytes into their component fields, including the PSD Serial Number. The PSD Serial Number is then used to retrieve data stored in the reset database 97 related to that PSD 28, including the signing (or first) key for that PSD and Transaction history. The reset computer system 96 then uses the first 14 bytes of the IBI Lite under examination, and that signing key to produce the 20-byte HMAC. The first 6 bytes of this computed HMAC are compared to the last 6 bytes of the IBI Lite data, and if they match then the indicium is valid in terms of the HMAC generated by the PSD for that mail piece.

As evidence that the print indicium is not a copy, i.e., a forged duplicate of an earlier valid print indicium, the PSD Transaction history may be compared with the date the indicium was printed (if known) and the cycle count contained in the IBI Lite. Either the cycle count from the indicium should fall between the start and end cycle counts of exactly one PSD Transaction recorded in the reset database 97, or the cycle count from the indicium should be greater than the end cycle count of the last PSD Transaction recorded in the reset database 97. If the Transaction in which the mail piece was printed is found, the date of the Transaction from the reset database 97 should match the date the indicium was printed (if known). If the cycle count from the indicium exceeds the end cycle count of the last PSD Transaction recorded in the reset database, then the indicium should only have been printed on or after the date of the last PSD Transaction recorded in the reset database.

In addition, or alternative, to the authentication code being a part of the IBI Lite barcode, the HMAC received by the host computer system 12 from PSD 28 may be printed in other representations on an envelope or other mailing item. For example, OneCode represents a four state code as described in USPS Publication, titled "Introducing OneCode Confirm", Rev. 8.2, USPS, Mar. 15, 2006. The OneCode has 31 digits maximum, in which the fifteen digits designated for the customer identifier and sequence number may be used to represent part of the HMAC. The OneCode barcode may be printed by mailing machine 10 by providing an additional print head oriented to print the barcode on envelopes, or in printer 80 by programming the host computer system 12 coupled thereto to output this barcode on an envelope or other mailing item, or adhesive label media, or by printer 104 by including this barcode in the print page such as above the address. Evidencing may be provided by reading the part of the HMAC stored in the OneCode, then locating and verifying the HMAC utilizing the transaction data stored in database 97 of reset computer system 96. Like analyzing the part of the HMAC coded in the IBI Lite barcode, if more than one embedded code in the OneCode existed in the reset computer system database 97, other data may be used for authentication, such as approximate date printed or actual date if printed on the mailing item. Although the OneCode barcode is described, any other barcode or other readable or scannable representation may be printed on mail or labels by machine 10, printer 80 or 104, in which all or part of such barcode or representation need only encode part (such as 6 bytes) of the HMAC authentication code to provide sufficient uniqueness for evidencing.

From the foregoing description, it will be apparent that an improved system and method for postal indicia printing, evidencing and accounting has been provided. Variations and modifications in the herein described system and method will undoubtedly become apparent to those skilled in the art. According the foregoing description should be taken as illustrative and not in a limiting sense.

The invention claimed is:

1. A system for printing indicia on mailing items, such as envelopes, cards, or label media, having a on IBI Lite barcode, and validating indicia read from mailing items, said system comprising:

a host computer system;

a postal security device connected for data communication with said host computer system, said postal security device, having memory storing postage funds, for at least sending to said host computer system, in response to a request from said host computer system for postage for said mailing item, at least a unique code having a first plurality of bytes of data generated by the postal security device for a mailing item in accordance with postal security device (psd) data, said psd data representing all the data used by said postal security device to generate said code;

said host computer system comprising a processor and a memory storing instructions that when executed causes the processor of the host computer system to perform at least the steps of extracting from said first plurality of bytes of data received from said postal security device a subset of bytes providing a second plurality of bytes of data, and producing print data representing at least a barcode representing at least part of said psd data, and said second plurality of bytes of data as part of said barcode; and another computer system for at least validating a read barcode of indicium comprising a processor and a memory storing instructions that when executed causes the processor of the another computer system to at least perform the steps of: generating another unique code having another one of said first plurality of bytes of data at least in accordance with at least part of the psd data of the read barcode, comparing a subset bytes of data of said another one of said first plurality of bytes of data to the second plurality of bytes of data of the read barcode, and validating the indicium having the read barcode in accordance with at least the results of said comparison.

2. The system according to claim 1 wherein said print data produced by said host computer system represents indicium for said mailing item having at least said barcode.

3. The system according to claim 2 wherein said print data produced by said host computer system further comprises one or more of image and text information.

4. The system according to claim 2 further comprising means for printing on said mailing item, in which said host computer system provides said print data to said printing means, and said printing means to prints said indicium upon said mailing item in accordance with said print data.

5. The system according to claim 4 wherein said printing means comprises a mailing machine having a print-head.

6. The system according to claim 4 wherein said printing means comprises a stand-alone printer.

7. The system according to claim 4 wherein said printing means comprises a printing system having another computer system and a printer for printing on said mailing item responsive to said another computer system, and said another computer system receives said print data from said host computer system, and formats said print data with other data for printing by said printer.

8. The system according to claim 7 wherein said other data represents at least an address.

9. The system according to claim 1 wherein said postal security device comprises means for generating said code.

10. The system according to claim 1 wherein said request comprises at least a postage value associated with said mailing item, and said postal security device comprises registers associated with said postage funds, and a counter representing the number of mailing items processed by said postal security device, and said registers are updated and said counter indexed in accordance with each request from said host computer system.

11. The system according to claim 10 wherein said code represents an indicium code, and different groups of one or more of said mailing items represent a transaction, and said host computer system has memory and stores in said memory of said host computer system transaction data having at least for each transaction the beginning and ending status of the postal security device associated with said registers and counter, a date and time associated with said beginning status, a date and time associated with said ending status, at least part of the indicium code, and postage value of each of said one or more of said mailing items of the transaction.

12. The system according to claim 11 wherein said host computer system has means for generating a transaction code authenticating said transaction, and said transaction data for said transaction further comprises said transaction code.

13. The system according to claim 1 wherein said host computer system has a housing and said postal security device is located in said housing.

14. The system according to claim 1 wherein said postal security device is contained in a tamper proof container.

15. The system according to claim 11 further comprising a plurality of said host computer system each having connected thereto one of said postal security device with a unique serial number.

16. The system according to claim 15 further comprising a reset computer system having a reset database storing postage funds available for the postage security device of each of said plurality of said host computer systems, in which said reset computer system communicates over a network with each of said plurality of host computer systems for receiving and storing said transaction data in said reset database with the unique serial number of the postal security device associated with the host computer system since said host computer system was last in data communication with said reset computer system, and said another computer system represents said reset computer system.

17. The system according to claim 16 wherein the postage security device of each of said plurality of host computer system requests additional funds from said reset computer system via said network and the host computer system, and said reset computer system upon authenticating the postage security device instructs the postal security device to make such additional funds available at the postage security device.

18. The system according to claim 1 wherein each said request is associated with a different mailing item, and said mailing item represents one of an envelope, card, or label media.

19. A method for generating indicia for printing on mailing items, such as envelopes, cards, or label media, having a barcode, and validating indicia read from mailing items, said method comprising the steps of:

sending a request from a computer system for postage for a mailing item to a postal security device storing postage funds;

generating by the postal security device a unique code in accordance with postal security device (psd) data, said psd data representing all the data used by said postal security device to generate said code, said unique code having a first plurality of bytes of data in response to said request;

sending data from the postal security device to the requesting computer system representing at least said code;

extracting a second plurality of bytes of data representing a subset of bytes from said first plurality of bytes of data;

producing print data representing indicium having at least a barcode representing at least part of said psd data, and said second plurality of bytes of data;

printing said print data on said mailing item;

reading a barcode of indicium being subject to validation;

generating another unique code having another one of said first plurality of bytes of data at least in accordance with at least part of the psd data of the read barcode;

comparing a subset bytes of data of said another one of said first plurality of bytes of data to the second plurality of bytes of data of the read barcode; and validating the indicium having the read barcode in accordance with at least the results of said comparing step.

20. The method according to claim 19 wherein said print data produced by said computer system further comprises one or more of image and text information.

21. The method according to claim 19 wherein a group of one or more mailing items represents a transaction, and said method further comprising the step of:

storing transaction data at said host computer system representing at least the postage value and at least part of said code for each mailing item of the transaction.

22. The method according to claim 21 further comprising the step of:

sending the transaction data from said computer system over a network to another computer system for storage of said transaction data.

23. The method according to claim 22 further comprising the step of:

resetting the postage funds stored in said postal security device by said another computer system.

24. A system for printing and evidencing information on mailing items, such as envelopes, cards, or label media, comprising:

a computer system;

a postal security device connected for data communication with said computer system, said postal security device for at least generating, in response to a request from said computer system, a unique code having first data for a mailing item in accordance with postal security device (psd) data, said psd data representing all the data used by said postal security device to generate said code;

said computer system comprising a processor and a memory storing instructions that when executed causes the processor of the computer system to perform at least the steps of receiving at least said unique code from said postage security device, extracting a subset of data from said first data, and producing print data representing at least a barcode representing at least part of said psd data, and said subset of data, said subset of data being smaller in total data size than said first data;

means for printing at least said print data on said mailing item; and another computer system for at least validating a read barcode of indicium comprising a processor and a memory storing instructions that when executed causes the processor of the another computer system to at least perform the steps of: generating another unique code having another one of said first data at least in accordance with at least part of the psd data of the read barcode, comparing a subset of data of said another one of said first data to a subset of data of the read barcode, and validating the indicium having the read barcode in accordance with at least the results of said comparison.

25. The system according to claim 24 wherein said barcode represents one of a OneCode barcode or IBI Lite barcode.

26. The system according to claim 24 wherein said printing means comprises one of a mailing machine, stand-alone printer, or printing system.

27. The system according to claim 1 wherein said mailing item is one of a plurality of mailing items and said postage security device generates a different one of said unique code for each of said plurality of mail items.

28. The system according to claim 27 further comprising memory and said host computer system stores in said memory information having at least said second plurality of bytes of data for each of said plurality of mail items.

29. The system according to claim 1 wherein said barcode is represented by barcode data having a plurality of fields, and one of said plurality of fields has said second plurality of bytes of data.

30. An apparatus for dispensing postage responsive to a computer system associated with a mailing machine, stand-alone printer, or printing system for printing postage indicia on one or more mailing items, said apparatus comprising:

means for receiving a request from a computer system for postage for a mailing item;

means, responsive to said request, for generating a unique code for the mailing item representing first data having a total data size in accordance with second data representing all the data used to generate said code;

means for sending data to the computer system having at least said unique code generated for the mailing item;

means for determining barcode data from said data sent having at least part of said second data, and only a subset of data extracted from said first data of said unique code;

means for printing at least a barcode representing said barcode data on said mailing item; and an evidencing system comprising: means for generating another unique code having another one of said first data at least in accordance with at least part of the second data of the data representing a read barcode, means for comparing a subset of said another one of said first data to a subset of the data representing the read barcode, and means for validating the read barcode in accordance with at least the results of said comparing means.

31. The apparatus according to claim 30 further comprising a computer system, said computer system having memory, and said computer system stores information in said memory related to said postage dispensed along with said received code.

32. The system according to claim 1 wherein said second plurality of bytes of data represents different pre-designated ones of said first plurality of bytes of data.

33. The system according to claim 1 wherein said memory of said postal security device has at least a secret key, and said unique code is cryptographically generated by said postal security device based on said secret key.

34. The system according to claim 1 wherein said second plurality of bytes of data are six in number.

35. The system according to claim 1 wherein said second plurality of bytes of data are six or less in number.

36. The system according to claim 1 wherein second plurality of bytes of data represents only a number of the first bytes of said first plurality of bytes of data.

37. The system according to claim 29 wherein said one of said plurality of fields is limited in size to contain at most said second plurality of bytes of data.

* * * * *